US011291906B2

(12) United States Patent
Jensen et al.

(10) Patent No.: US 11,291,906 B2
(45) Date of Patent: Apr. 5, 2022

(54) HEADGEAR INCLUDING FORCE ABSORBING FEATURES

(71) Applicant: HANSEN PHARMACEUTICAL, LLC, South Miami, FL (US)

(72) Inventors: Daniel Robert Jensen, Palm City, FL (US); Jason R. Hanft, Coral Gables, FL (US); Jeffrey L. Jensen, Palm City, FL (US); Adam Scott Landsman, Weston, MA (US)

(73) Assignee: HANSEN PHARMACEUTICAL, LLC, South Miami, FL (US)

( * ) Notice: Subject to any disclaimer, the term of this patent is extended or adjusted under 35 U.S.C. 154(b) by 230 days.

(21) Appl. No.: 16/488,917

(22) PCT Filed: Feb. 23, 2018

(86) PCT No.: PCT/US2018/019487
§ 371 (c)(1),
(2) Date: Aug. 26, 2019

(87) PCT Pub. No.: WO2018/160463
PCT Pub. Date: Sep. 7, 2018

(65) Prior Publication Data

US 2020/0001164 A1 Jan. 2, 2020

Related U.S. Application Data

(60) Provisional application No. 62/464,893, filed on Feb. 28, 2017.

(51) Int. Cl.

| | |
|---|---|
| ***A41D 20/00*** | (2006.01) |
| ***A63B 71/10*** | (2006.01) |
| ***A42B 3/12*** | (2006.01) |

(52) U.S. Cl.
CPC ..... *A63B 71/10* (2013.01); *A41D 20/00* (2013.01); *A42B 3/124* (2013.01); *A63B 2209/10* (2013.01)

(58) Field of Classification Search
CPC ..... A41D 20/00; A42B 3/124; A63B 71/10
See application file for complete search history.

(56) References Cited

U.S. PATENT DOCUMENTS 4,354,284 A * 10/1982 Gooding ..... A42B 3/00 2/413
4,646,367 A * 3/1987 El Hassen ..... A42B 3/00 2/171

(Continued)

OTHER PUBLICATIONS

"Material Properties of Sorbothane(R)—Data Sheet 101"; Sorbothane, Inc. (Jan. 27, 2019), 2 pages.

*Primary Examiner* — Tajash D Patel
(74) *Attorney, Agent, or Firm* — Polsinelli PC

(57) ABSTRACT

Headgear includes a base configured to engage the head of the wearer. A force absorbing structure is carried by the base. In some cases, the force absorbing structure includes a surface including a coarse macrostructure configured to facilitate absorbing forces applied to the headgear. The coarse macrostructure includes a plurality of protrusions, and at least one of the protrusions has a thickness of at least about 0.50 mm. In some cases, the force absorbing structure includes a porous macrostructure configured to facilitate absorbing forces applied to the headgear. The porous macrostructure includes a plurality of passageways each having a width of at least about 2.00 mm.

16 Claims, 6 Drawing Sheets

(56) References Cited

U.S. PATENT DOCUMENTS

| | | | | |
|---|---|---|---|---|
| 5,172,494 | A | 12/1992 | Davidson | |
| 5,963,989 | A | 10/1999 | Robertson | |
| 6,381,760 | B1 * | 5/2002 | Lampe | A42B 3/00 2/414 |
| 7,673,351 | B2 * | 3/2010 | Copeland | A42B 3/124 2/425 |
| 8,087,101 | B2 * | 1/2012 | Ferguson | A42B 3/124 2/455 |
| 9,439,468 | B1 | 9/2016 | Blagg | |
| 9,795,177 | B1 * | 10/2017 | Weaver | A42B 3/046 |
| 2015/0335079 | A1 | 11/2015 | Lacey | |

* cited by examiner

HEADGEAR INCLUDING FORCE ABSORBING FEATURES

CROSS-REFERENCE TO RELATED APPLICATION

The present application claims the benefit of and priority to, under 35 U.S.C. § 119(e), U.S. Provisional Application Ser. No. 62/464,893, filed Feb. 28, 2017, entitled HEADGEAR INCLUDING FORCE ABSORBING FEATURES, which is hereby incorporated by reference in its entirety for all purposes.

TECHNICAL FIELD

Embodiments of the present disclosure relate generally to headgear to be worn during physical activities, and more particularly headgear including features for absorbing impact forces applied to the head of a wearer.

BACKGROUND

In recent years, increasing attention has been directed to head injuries (for example, concussions and other trauma) sustained during physical activities. However, little development has been done in an attempt to provide improved headgear outside of activities that typically involve use of helmets by participants (for example, football, soccer, lacrosse and ice hockey).

SUMMARY

Headgear according to an embodiment of the present disclosure includes a base configured to engage the head of the wearer; and a force absorbing structure carried by the base, the force absorbing structure comprising a surface comprising a coarse macrostructure configured to facilitate absorbing forces applied to the headgear, the coarse macrostructure comprising a plurality of protrusions, and at least one of the protrusions comprising a thickness of at least about 0.50 mm.

The headgear of paragraph [0004], wherein at least some of the protrusions are defined by a plurality of recesses, and at least some of the recesses comprise concave semi-spherical surfaces.

The headgear of any of paragraphs [0004] to [0005], wherein the force absorbing structure comprises a first layer comprising the coarse macrostructure, the coarse macrostructure being a first coarse macrostructure; and a second layer comprising a surface comprising a second coarse macrostructure configured to facilitate absorbing forces applied to the headgear, the second coarse macrostructure comprising a plurality of protrusions, and at least one of the protrusions comprising a thickness of at least about 0.50 mm.

The headgear of any of paragraphs [0004] to [0006], wherein at least some of the protrusions of the first coarse macrostructure are defined by a first plurality of recesses, at least some of the first plurality of recesses comprise concave semi-spherical surfaces, wherein at least some of the protrusions of the second coarse macrostructure are defined by a second plurality of recesses, at least some of the second plurality of recesses comprise concave semi-spherical surfaces.

The headgear of any of paragraphs [0004] to [0007], wherein at least some of the first plurality of recesses face toward the second layer, and at least some of the second plurality of recesses face toward the first layer.

The headgear of any of paragraphs [0004] to [0008], wherein at least some of the protrusions are arranged in a pattern.

The headgear of any of paragraphs [0004] to [0009], wherein the force absorbing structure comprises a viscoelastic polymer.

The headgear of any of paragraphs [0004] to [0010], wherein the force absorbing structure comprises a material having a damping coefficient in a range of 0.54 to 0.35.

The headgear of any of paragraphs [0004] to [0011], wherein the force absorbing structure comprises: a first portion having a first damping coefficient; and a second portion having a second damping coefficient; wherein the first damping coefficient is greater than the second damping coefficient.

The headgear of any of paragraphs [0004] to [0012], wherein the base defines an internal chamber, and the force absorbing structure is carried within the internal chamber.

The headgear of any of paragraphs [0004] to [0013], wherein the base comprises a fabric.

Headgear according to another embodiment of the present disclosure includes a base configured to engage the head of the wearer; and a force absorbing structure carried by the base, the force absorbing structure comprising a viscoelastic polymer to facilitate absorbing forces applied to the headgear.

The headgear of paragraph [0015], wherein the viscoelastic polymer is a thermoset, polyether-based, polyurethane.

The headgear of any of paragraphs [0015] to [0016], wherein the force absorbing structure comprises a material having a damping coefficient in a range of 0.54 to 0.35.

The headgear of any of paragraphs [0015] to [0017], wherein the force absorbing structure comprises: a first portion having a first damping coefficient; and a second portion having a second damping coefficient; wherein the first damping coefficient is greater than the second damping coefficient.

The headgear of any of paragraphs [0015] to [0018], wherein the base defines an internal chamber, and the force absorbing structure is carried within the internal chamber.

The headgear of any of paragraphs [0015] to [0019], wherein the base comprises a fabric.

Headgear according to yet another embodiment of the present disclosure includes a base configured to engage the head of the wearer; and a force absorbing structure carried by the base, the force absorbing structure comprising a material having a damping coefficient in a range of 0.54 to 0.35.

The headgear of paragraph [0021], wherein the force absorbing structure comprises: a first portion having a first damping coefficient; and a second portion having a second damping coefficient; wherein the first damping coefficient is greater than the second damping coefficient.

The headgear of any of paragraphs [0021] to [0022], wherein the first portion is a frontal portion configured to be disposed adjacent and provide protection for the frontal skull bone of the wearer, and the second portion is a temporal portion configured to be disposed adjacent and provide protection for a temple of the wearer.

Headgear according to yet another embodiment of the present disclosure includes a base configured to engage the head of the wearer; and a force absorbing structure carried by the base, the force absorbing structure comprising a porous macrostructure configured to facilitate absorbing forces applied to the headgear, the porous macrostructure comprising a plurality of passageways extending in a thickness direction from a first side of the force absorbing structure to a second side of the force absorbing structure, the plurality of passageways each comprising a width in a direction perpendicular to the thickness direction, and the width being at least about 2.00 mm.

The headgear of paragraph [0024], wherein the width is at least about 3.50 mm.

The headgear of any of paragraphs [0024] to [0025], wherein the width is at least about 5.00 mm.

The headgear of any of paragraphs [0024] to [0026], wherein the plurality of passageways each comprise a tapering shape, and the width is a maximum width.

The headgear of any of paragraphs [0024] to [0027], wherein the plurality of passageways each comprise a symmetric tapering shape.

The headgear of any of paragraphs [0024] to [0028], wherein the plurality of passageways each comprise a minimum width in a direction perpendicular to the thickness direction, and the minimum width is at least about 0.50 mm.

The headgear of any of paragraphs [0024] to [0029], wherein the minimum width is at least about 1.25 mm.

The headgear of any of paragraphs [0024] to [0030], wherein the minimum width is at least about 2.00 mm.

Headgear according to yet another embodiment of the present disclosure includes a base configured to engage the head of the wearer; and a force absorbing structure carried by the base, the force absorbing structure comprising a porous macrostructure configured to facilitate absorbing forces applied to the headgear, the porous macrostructure comprising a plurality of passageways extending in a thickness direction from a first side of the force absorbing structure to a second side of the force absorbing structure, the plurality of passageways each comprising a symmetric tapering shape.

The headgear of paragraph [0032], wherein the plurality of passageways each comprise an axisymmetric tapering shape.

The headgear of any of paragraphs [0032] to [0033], wherein the plurality of passageways each comprise a frusto-conical shape.

The headgear of any of paragraphs [0032] to [0034], wherein the frusto-conical shape is a first frusto-conical shape, the plurality of passageways each further comprise a second frusto-conical shape, and the first frusto-conical shape and the second frusto-conical shape comprise a common smaller end.

The headgear of any of paragraphs [0032] to [0035], wherein the plurality of passageways each comprise a maximum width in a direction perpendicular to the thickness direction, and the maximum width is at least about 2.00 mm.

The headgear of any of paragraphs [0032] to [0036], wherein the plurality of passageways each comprise a minimum width in a direction perpendicular to the thickness direction, and the minimum width is at least about 0.50 mm.

The headgear of any of paragraphs [0032] to [0037], wherein the plurality of passageways are each symmetric over a plane perpendicular to the thickness direction.

While multiple embodiments are disclosed, still other embodiments of the present disclosure will become apparent to those skilled in the art from the following detailed description, which illustrates and describes embodiments of the disclosure. Accordingly, the drawings and detailed description are to be regarded as illustrative in nature and not restrictive.

Figure 1B:
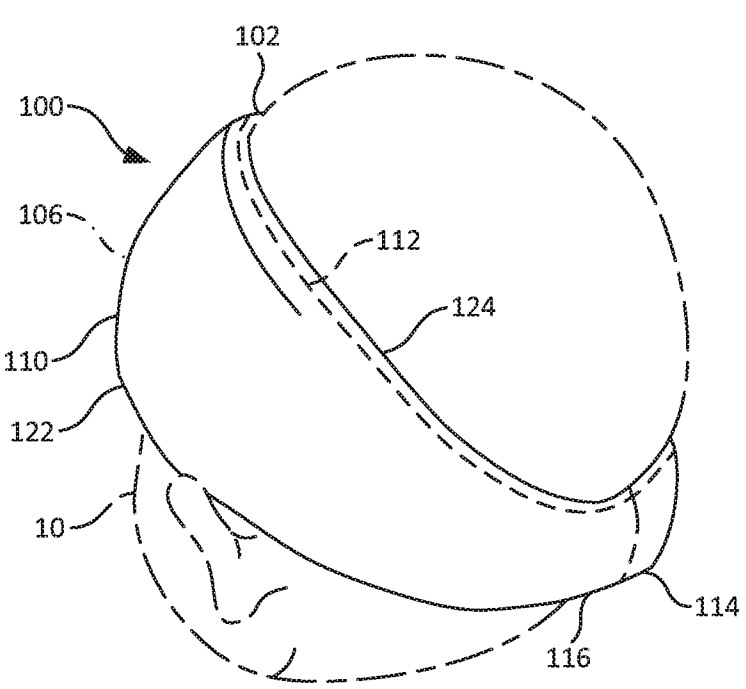
FIG. 1B illustrates a rear perspective view of the headgear of FIG. 1A being worn on the head of the wearer.
Figure 1A:
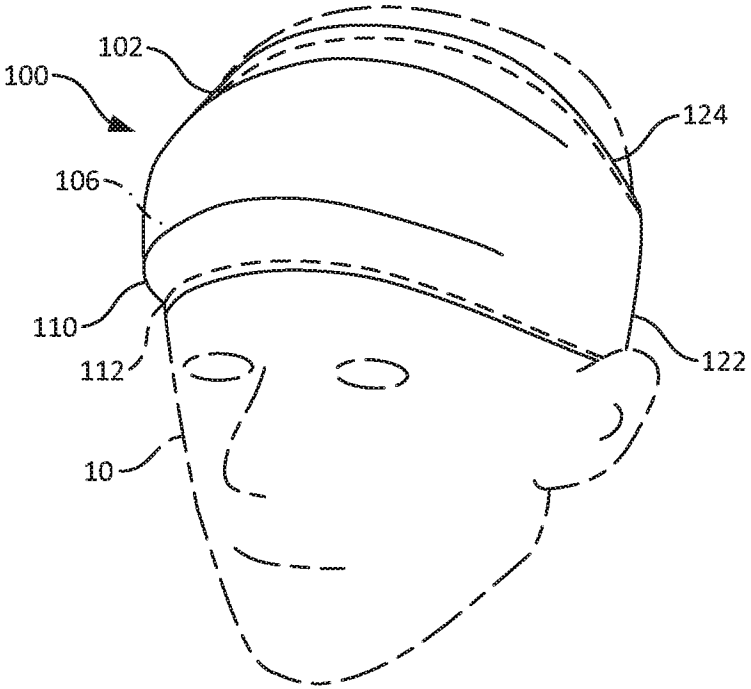
FIG. 1A illustrates a front perspective view of an embodiment of headgear according to the present disclosure being worn on the head of a wearer.

While the disclosure is amenable to various modifications and alternative forms, specific embodiments have been demonstrated by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

Embodiments of headgear according to the present disclosure may be worn during various physical activities to absorb impact forces applied to the head of a wearer. Examples of activities in which embodiments of headgear could be worn include soccer, lacrosse, basketball, volleyball, rugby, handball, rock climbing, and parkour. Impact forces applied to the head of the wearer could be caused by contact with, for example, other equipment used during physical activities (balls, soccer goals, lacrosse sticks, basketball surfaces, and the like), other persons (other activity participants, referees, spectators, and the like), and natural objects (the ground, rocks, and the like). Embodiments of headgear according to the present disclosure may be worn for protection for children and adults suffering from medical conditions causing seizures, uncontrollable head movements, and/or other medical conditions.

Referring now to FIGS. 1A-3, an embodiment of headgear 100, which may also be referred to as a "headband", is configured to be worn on the head of a wearer 10. The headgear 100 includes a base 102 configured to engage the head of the wearer 10. The base 102 includes an internal chamber 104 (see FIG. 3) that carries a force absorbing structure 106. The force absorbing structure 106 is configured to absorb impact forces applied to the head of the wearer 10. The base 102, the force absorbing structure 106, and other aspects of the headgear 100 are described in further detail below.

In some embodiments, the base 102 is formed from a flexible fabric material, such as cotton, cotton blends (for example, a blend of cotton and polyester or a blend of cotton, polyester, and rayon), or the like. Such a fabric may include woven or knitted fibers. Alternatively, the base 102 may be formed of various other materials, such as polymers, papers, and the like.

The base 102 includes a first side or inner side 108 (see FIG. 3) that is configured to engage the head of the wearer 10. The inner side 108 is coupled to a second or outer side 110 that faces away from the head of the wearer 10. The internal chamber 104 is situated between the inner side 108 and the outer side 110. In some embodiments and as illustrated in the figures, the inner side 108 and the outer side 110 may be non-detachably coupled (for example, via stitching 112). In some embodiments, the inner side 108 and the outer side 110 may be detachably coupled (for example, via hook and loop fasteners (not shown)) to facilitate, for example, separating the base 102 from the force absorbing structure 106 and cleaning the base 102. In some embodiments, the inner side 108 and the outer side 110 may be monolithically formed with each other. In some embodiments, one of the inner side 108 or the outer side 110 could be omitted, and the force absorbing structure 106 could be coupled (detachably or non-detachably) to the other side.

In some embodiments and as illustrated in the figures, the base 102 includes a first end 114 and a second end 116 that detachably couple to each other to secure the headgear 100 to the wearer 10. As illustrated in FIG. 1B, the first end 114 and the second end 116 are typically positioned posteriorly relative to the head of the wearer 10. The first end 114 and the second end 116 may be detachably coupled, for example, via hook and loop fasteners 118, 120 (see FIG. 2). In some embodiments, the first end 114 and the second end 116 may be non-detachably coupled (for example, via stitching (not shown)). In some embodiments, the first end 114 and the second end 116 may be monolithically formed with each other (in other words, the base 102 may be continuous or endless).

Figure 2:
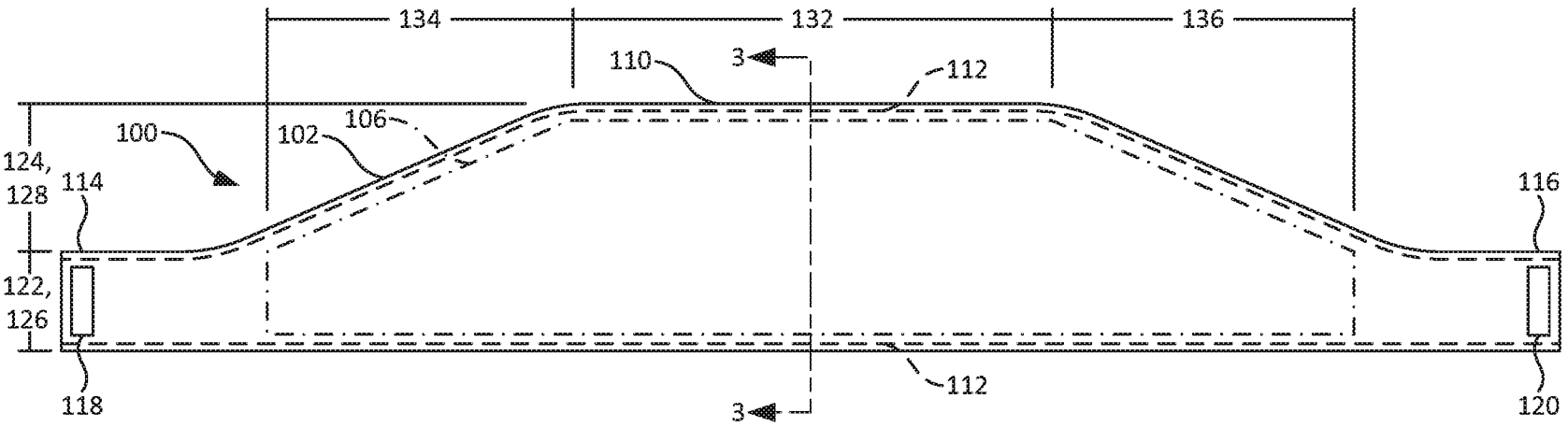
FIG. 2 illustrates a front view of the headgear of FIG. 1A. Stitching is shown as dashed lines and internal components are shown as dash-dotted lines.

As shown most clearly in FIG. 2, the base 102 includes a base main portion 122 that is configured to extend about the head of the wearer 10 and defines the first end 114 and the second end 116. The base main portion 122 may have a rectangular shape. The base 102 also includes a base secondary portion 124 that is configured to be disposed adjacent to and provide protection for the superior portion of the squamous part of the frontal skull bone of the wearer 10 (that is, above the forehead). The base secondary portion 124 may have a trapezoidal shape. In some embodiments and as illustrated in the figures, the base main portion 122 and the base secondary portion 124 may be continuous and monolithically formed with each other.

The force absorbing structure 106 includes one or more materials that facilitate absorbing impact forces applied to the head of the wearer 10. In some embodiments, the force absorbing structure 106 includes a material that has a damping coefficient (also referred to as the tangent of delta, which is the out-of-phase time relationship between receiving an impact or vibration and transmitting a force to an adjacent structure) in a range of 0.6 to 0.2 (at 5 Hz excitation). In some embodiments, the force absorbing structure 106 includes a material that has a damping coefficient in a range of 0.57 to 0.3 (at 5 Hz excitation). In some embodiments, the force absorbing structure 106 includes a material that has a damping coefficient in a range of 0.54 to 0.35 (at 5 Hz excitation). In some embodiments, the force absorbing structure 106 includes a material that has a Shore 00 durometer in a range of 10 to 80. In some embodiments, the force absorbing structure 106 includes a material that has a Shore 00 durometer in a range of 20 to 70. In some embodiments, the force absorbing structure 106 includes a material that has a Shore 00 durometer in a range of 40 to 60. In some embodiments, the force absorbing structure 106 includes a material that has a Shore 00 durometer in a range of 40 to 50. An example of a material that may include the above properties is a viscoelastic polymer. The viscoelastic polymer may be a thermoset, polyether-based, polyurethane, such as, for example, Sorbothane® available from Sorbothane, Incorporated of Kent, Ohio.

The force absorbing structure 106 includes a force absorbing main portion 126 (see FIG. 2) that is disposed within the base main portion 122. The force absorbing main portion 126 may have a rectangular shape. The force absorbing structure 106 also includes a force absorbing secondary portion 128 (see FIG. 2) that is disposed within the base secondary portion 124 of the base 102. The force absorbing secondary portion 128 may have a trapezoidal shape. In some embodiments and as shown in the figures, the force absorbing main portion 126 and the force absorbing secondary portion 128 may be monolithically formed with each other.

Figure 4:
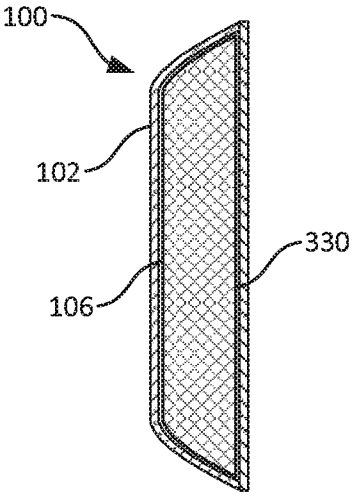
FIG. 4 illustrates a side section view of another embodiment of headgear according to the present disclosure.
Figure 3:
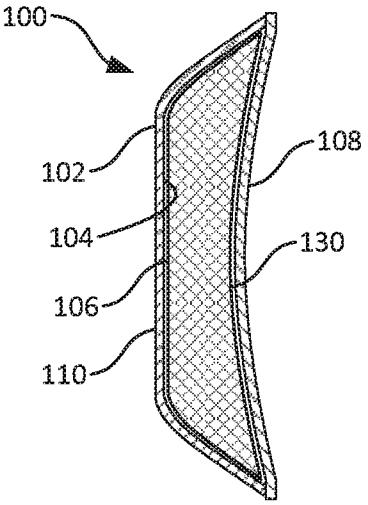
FIG. 3 illustrates a side sectional view of the headgear along line 3-3 of FIG. 2.

In some embodiments and as shown in the FIG. 3, the force absorbing structure 106 includes a concave inner surface 130 to facilitate, for example, comfort against the head of the wearer 10. In other embodiments and as shown in FIG. 4 in transverse cross-section, the force absorbing structure 106 includes a flat or substantially flat inner surface 330.

In some embodiments, the force absorbing structure 106 has a maximum thickness (that is, a dimension extending between the inner side 108 and the outer side 110 of the base 102, or a direction extending into the page on FIG. 2) in a range of 0.5 mm to 2.5 mm. In some embodiments, the force absorbing structure 106 has a maximum thickness of about 1 mm (that is, 1 mm±0.2 mm).

In some embodiments, the force absorbing structure 106 may include different portions that have different properties. Force absorbing structures 106 including different portions with different properties may be monolithically manufactured or non-monolithically manufactured. For non-monolithically manufactured structures, different portions could be formed as single layers including different properties, or by stacking layers of materials including different properties in different portions. As an example, different portions of the force absorbing structure 106 may have different hardnesses. As an example, one or more portions of the force absorbing structure 106 may have a first hardness, one or more portions of the force absorbing structure 106 may have a second hardness, and the first hardness may be less than the second hardness. As an example, a frontal portion 132 (that is, a portion configured to be disposed adjacent and provide protection for the frontal skull bone of the wearer 10) may have a Shore 00 durometer of about 40 (that is, 40±2.5), and two temporal portions 134, 136 (that is, portions configured to be disposed adjacent and provide protection for the temples of the wearer 10) may have a Shore 00 durometer of about 50 (that is, 50±2.5). As another example, different portions of the force absorbing structure 106 may have different damping coefficients. As an example, one or more portions of the force absorbing structure 106 may have a first damping coefficient, one or more portions of the force absorbing structure 106 may have a second damping coefficient, and the first damping coefficient may be greater than the second damping coefficient. As an example, the frontal portion 132 may have a damping coefficient of about 0.49 (at 5 Hz excitation) (that is, 0.49±0.05 (at 5 Hz excitation)), and the temporal portions 134, 136 may have a damping coefficient of about 0.40 (that is, 0.40±0.05 (at 5 Hz excitation)).

In some embodiments, the headgear 100 is relatively lightweight compared to other types of headgear worn during physical activities (for example, football helmets).

Referring now to FIGS. 5-9, another embodiment of headgear 400, which may also be referred to as a headband, is shown. The headgear 400 includes a base 402 configured to engage the head of the wearer. The base 402 includes an internal chamber 404 (see FIG. 8) that carries a force absorbing structure 406. The force absorbing structure 406 is configured to absorb impact forces applied to the head of the wearer. The base 402, the force absorbing structure 406, and other aspects of the headgear 400 are described in further detail below.

The base 402 may be formed, for example, from any of the materials described above in connection with the base 102. The base 402 includes a first side or inner side 408 (see FIG. 8) that is configured to engage the head of the wearer. The inner side 408 is coupled to a second or outer side 410 that faces away from the head of the wearer. The internal chamber 404 is situated between the inner side 408 and the outer side 410. In some embodiments and as illustrated in part in the figures, the inner side 408 and the outer side 410 may be non-detachably coupled (for example, via stitching 412). In some embodiments, the inner side 408 and the outer side 410 may be detachably coupled (for example, via hook and loop fasteners (not shown)) to facilitate, for example, separating the base 402 from the force absorbing structure 406 and cleaning the base 402. In some embodiments, the inner side 408 and the outer side 410 may be monolithically formed with each other. In some embodiments, one of the inner side 408 or the outer side 410 could be omitted, and the force absorbing structure 406 could be coupled (detachably or non-detachably) to the other side.

In some embodiments and as shown in the figures, the base 402 includes a first end 414 and a second end 416 that detachably couple to each other to secure the headgear 400 to the wearer. The first end 414 and the second end 416 are typically positioned posteriorly relative to the head of the wearer. The first end 414 and the second end 416 may be detachably coupled, for example, via hook and loop fasteners 418, 420 (see FIG. 5). In some embodiments, the first end 414 and the second end 416 may be non-detachably coupled (for example, via stitching (not shown)). In some embodiments, the first end 414 and the second end 416 may be monolithically formed with each other (in other words, the base 402 may be continuous or endless).

The base 402 includes a base main portion 422 that is configured to extend about the head of the wearer and defines the first end 414 and the second end 416. The base main portion 422 may have a rectangular shape. Such a rectangular shape may have a length (that is, a dimension extending in the left-right direction on FIG. 5) of about 508.00 mm (that is, 508.00 mm±12.70 mm) and a height (that is, a dimension extending in the top-bottom direction on FIG. 5) of about 82.55 mm (that is, 82.55 mm±12.70 mm). The base 402 also includes a base secondary portion 424 that is configured to be disposed adjacent and provide protection for the superior portion of the squamous part of the frontal skull bone of the wearer. The base secondary portion 424 may have a trapezoidal shape. Such a trapezoidal shape may have a larger base length of about 381.00 mm (that is, 381.00 mm±12.70 mm), a smaller base length of about 200.00 mm (that is, 200.00 mm±12.70 mm), and a height of about 19.00 mm (that is, 19.00 mm±12.70 mm). In some embodiments and as illustrated in part in the figures, the base main portion 422 and the base secondary portion 424 may be monolithically formed with each other.

The force absorbing structure 406 may be formed, for example, from any of the materials described above in connection with the force absorbing structure 106. The force absorbing structure 406 may have a rectangular shape with rounded corners disposed near the base secondary portion 424 of the base 402. Such a shape may have a length of about 254.00 mm (that is, 254.00 mm±12.70 mm) and a height of about 50.80 mm (that is, 50.80 mm±12.70 mm). The force absorbing structure 406 may have corners that are beveled in the thickness direction (see FIGS. 6 and 7). The beveled corners may extend over a length and a height of about 12.70 mm (that is, 12.70 mm±0.50 mm).

Figure 8:
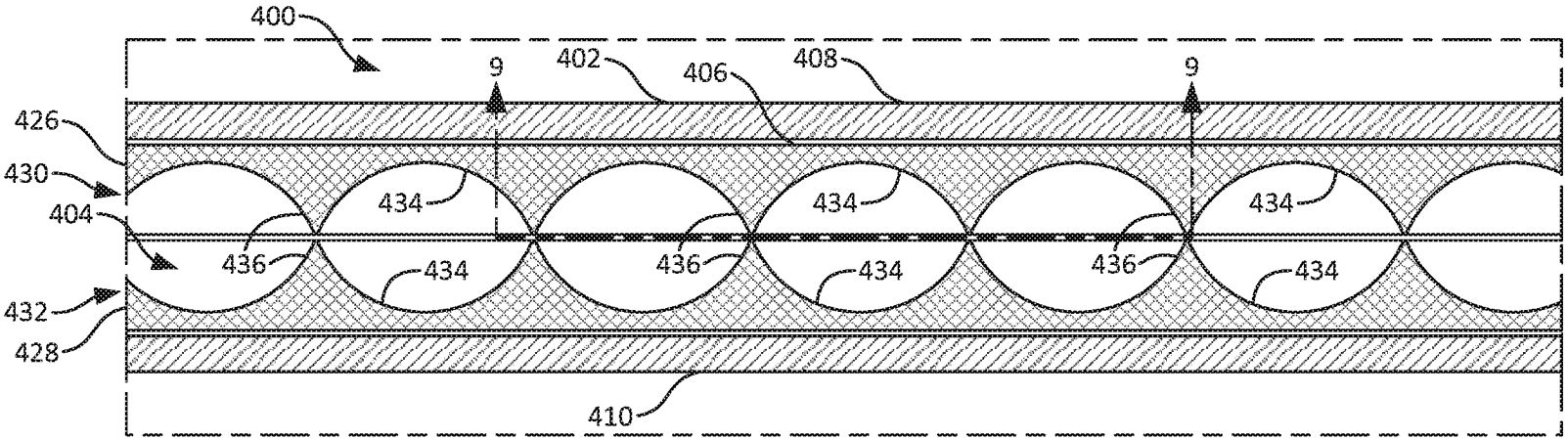
FIG. 8 illustrates a side section view of the force absorbing structure of the headgear along line 8-8 of FIG. 5.
Figure 9:
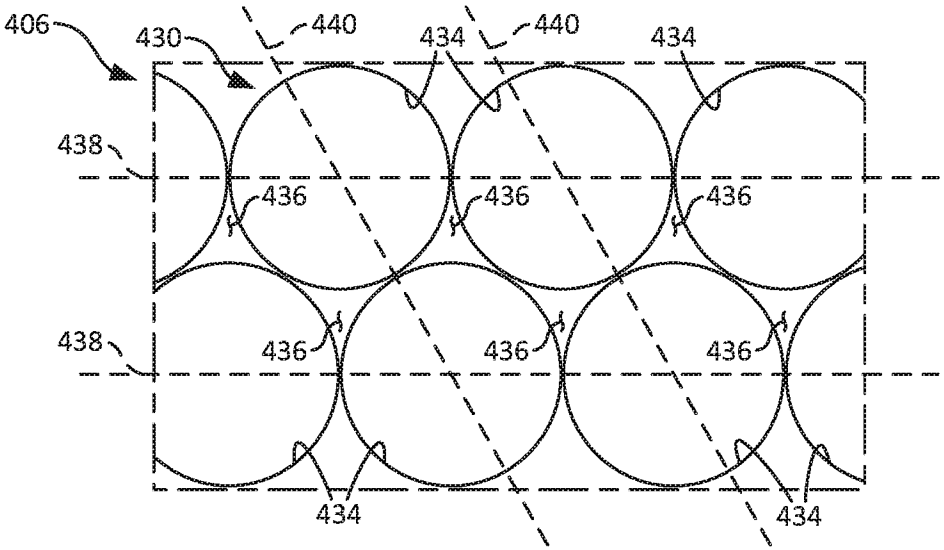
FIG. 9 illustrates a bottom section view of the force absorbing structure of the headgear along line 9-9 of FIG. 8. Components are illustrated with gaps therebetween for illustrative purposes.

Referring now to FIGS. 8-9, the force absorbing structure 406 may include a first layer 426 and a second layer 428. The first layer 426 and the second layer 428 may be detachably coupled, non-detachably coupled, or uncoupled. If the first layer 426 and the second layer 428 are uncoupled, they may be constrained in the internal chamber 404 due to the presence of the inner side 408 and the outer side 410.

The first layer 426 and/or the second layer 428 may include a surface having a coarse macrostructure 430, 432. The coarse macrostructures 430, 432 include a plurality of recesses 434, which may also be referred to as blind holes, and a plurality of protrusions 436, defined between the recesses 434, that facilitate absorbing impact forces applied to the headgear 400. The recesses 434 will typically collapse and the protrusions 436 will typically compress before the remainder of the first layer 426 and the second layer 428 compress when absorbing an impact force. In some embodiments and as shown in FIG. 8, both coarse macrostructures 430, 432 may face toward the other. In other embodiments (not shown), or one or both coarse macrostructures 430, 432 may face away from each other. The recesses 434 and protrusions 436 may be arranged in a pattern (see FIGS. 8 and 9) or randomly (not shown). The recesses 434 and protrusions 436 may have common dimensions (see FIGS. 8 and 9) or different dimensions (not shown). The recesses 434 and protrusions 436 may be spaced apart by common distances (see FIGS. 8 and 9) or different distances (not shown). The recesses 434 and protrusions 436 may have common shapes (see FIGS. 8 and 9) or different shapes (not shown). In some embodiments and as illustrated in FIG. 8, one or more of the recesses 434 may be aligned with a recess 434 on the other layer in a thickness direction (that is, a direction extending in the top-bottom direction on FIG. 8). In other embodiments (not shown), none of the recesses 434 may be aligned with a recess 434 on the other layer in the thickness direction. In some embodiments and as illustrated in FIG. 8, one or more of the protrusions 436 may be aligned with a protrusion 436 on the other layer in the thickness direction. In other embodiments (not shown), none of the protrusions 436 may be aligned with a protrusion 436 on the other layer in the thickness direction.

In some embodiments, one or more recesses 434 have depths of at least about 0.50 mm (that is, 0.50 mm±0.10 mm) (measured from the end of an adjacent protrusion), or at least about 0.75 mm (that is, 0.75 mm±0.10 mm), or at least about 1.00 mm (that is, 1.00 mm±0.10 mm). In some embodiments, one or more recesses 434 are spaced apart from adjacent recesses 434 by at least about 0.50 mm (that is, 0.50 mm±0.10 mm), or at least about 0.75 mm (that is, 0.75 mm±0.10 mm), or at least about 1.00 mm (that is, 1.00 mm±0.10 mm). In some embodiments, the remainder of each layer has a thickness in a range of 0.50 mm to 1.50 mm, or in a range of 0.75 mm to 1.25 mm, or about 1.00 mm (that is, 1.00 mm±0.10 mm). Conversely, the protrusions 436 have thicknesses that are equal to the depths of adjacent recesses 434.

As an example and as illustrated in the figures, the recesses 434 and protrusions 436 of the coarse macrostructures 430, 432 may be defined by a plurality of concave semi-spherical surfaces. The concave semi-spherical surfaces of the first layer 426 face toward the second layer 428, and the concave semi-spherical surfaces of the second layer 428 face toward the first layer 426. Each concave semi-spherical surface on the first layer 426 is aligned with one of the concave semi-spherical surfaces on the second layer 428 in the thickness direction. The concave semi-spherical surfaces are arranged in a pattern. For example, the concave semi-spherical surfaces are aligned along first parallel directions 438 on the layer and second parallel directions 440 on the layer, the first directions 438 being non-orthogonal with the second directions 440. The concave semi-spherical surfaces each have depths of about 1.00 mm (that is, 1.00 mm±0.10 mm).

In some embodiments and as illustrated in the figures, the remaining surfaces of the first layer 426 and 428 may lack coarse macrostructures.

In some embodiments, the headgear 400 is relatively lightweight compared to other types of headgear worn during physical activities (for example, football helmets).

The coarse macrostructures 430, 432 may have various other arrangements, shapes, and dimensions. For example, the recesses 434 and protrusions 436 may be defined by surfaces having various other shapes, such as semi-cubic shapes, semi-ellipsoidal shapes, semi-conic shapes, semi-pyramidal shapes, and the like. As another alternative, one of the layers could be omitted, and the remaining layer could include a coarse macrostructure 430 or 432.

In some embodiments, the force absorbing structure 406 may include different portions that have different properties. Force absorbing structures 406 including different portions with different properties may be monolithically manufactured or non-monolithically manufactured. For non-monolithically manufactured structures, different portions could be formed as single layers including different properties, or by stacking layers of materials including different properties in different portions. As an example, different portions of the force absorbing structure 406 may have different hardnesses. As an example, one or more portions of the force absorbing structure 406 may have a first hardness, one or more portions of the force absorbing structure 406 may have a second hardness, and the first hardness may be less than the second hardness. As an example, a frontal portion 442 (that is, a portion configured to be disposed adjacent and provide protection for the frontal skull bone of the wearer; see FIG. 6) may have a Shore 00 durometer of about 40 (that is, 40±2.5), and two temporal portions 444, 446 (that is, portions configured to be disposed adjacent and provide protection for the temples of the wearer; see FIG. 6) may have a Shore 00 durometer of about 50 (that is, 50±2.5). As another example, different portions of the force absorbing structure 406 may be different layers arranged in the thickness direction. In such embodiments, a first layer has a first hardness, a second layer has a second hardness, and the second hardness is different than the first hardness. As another example, different portions of the force absorbing structure 406 may have different damping coefficients. As an example, one or more portions of the force absorbing structure 406 may have a first damping coefficient, one or more portions of the force absorbing structure 406 may have a second damping coefficient, and the first damping coefficient may be greater than the second damping coefficient. As an example, the frontal portion 442 may have a damping coefficient of about 0.49 (at 5 Hz excitation) (that is, 0.49±0.05 (at 5 Hz excitation)), and the temporal portions 444, 446 may have a damping coefficient of about 0.40 (that is, 0.40±0.05 (at 5 Hz excitation)). Any of the above structures could alternatively be monolithically manufactured.

In some embodiments, the headgear includes a front element 448 that engages the forehead of the wearer and inhibits perspiration from moving toward the eyes of the wearer, such as one of the devices described in U.S. Pat. No. 6,567,991, the disclosure of which is hereby incorporated by reference.

Figure 5:
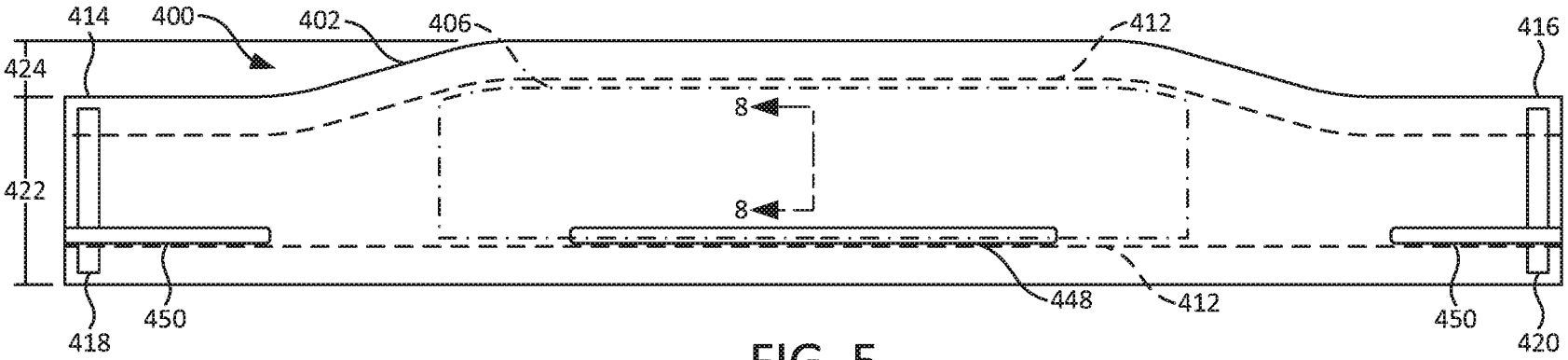
FIG. 5 illustrates a front view of another embodiment of headgear according to the present disclosure. Stitching is shown as dashed lines and internal components are shown as dash-dotted lines.
Figure 6:
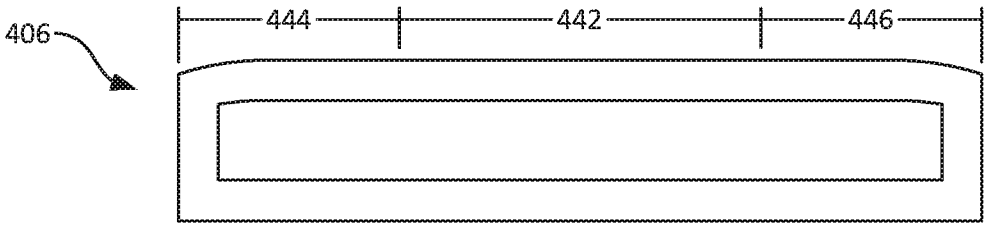
FIG. 6 illustrates a front view of a force absorbing structure of the headgear of FIG. 5.
Figure 7:
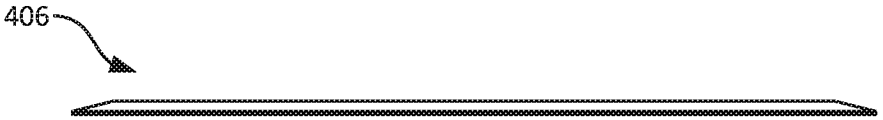
FIG. 7 illustrates an end view of the force absorbing structure of FIG. 6.

Referring again to FIG. 5, in some embodiments, the headgear includes a rear positioning element 450 that engages the back of the head of wearer to inhibit the headgear from unintentionally moving, or "slipping", relative to the head of the wearer. The rear positioning element 450 may have an elongated shape (that is, the rear positioning element 450 may have a minimum length of 5mm The rear positioning element 450 may be formed of a material that facilitates sealing against the skin of the wearer or resisting movement when contacting the hair of the wearer, such as silicone. As illustrated in FIG. 5, the rear positioning element 450 may be formed as two separate portions (for example, if the headgear includes detachable ends). In other embodiments, the rear positioning element 450 may be a single, monolithic component (for example, if the headgear is continuous or endless). In some embodiments, the rear positioning element 450 is discontinuous. In other embodiments, the rear positioning element 450 may be discontinuous from the front element 448. That is, the rear positioning element 450 is spaced apart from the front element 448 such that the elements 448, 450 are spaced apart from the ears of the wearer. In some embodiments, the rear positioning element 450 is not aligned with the front element 448. In some embodiments, the headgear 400 includes the front element 448 and lacks the rear positioning element 450. In other embodiments, the headgear 400 includes the rear positioning element 450 and lacks the front element 448.

Figure 10:
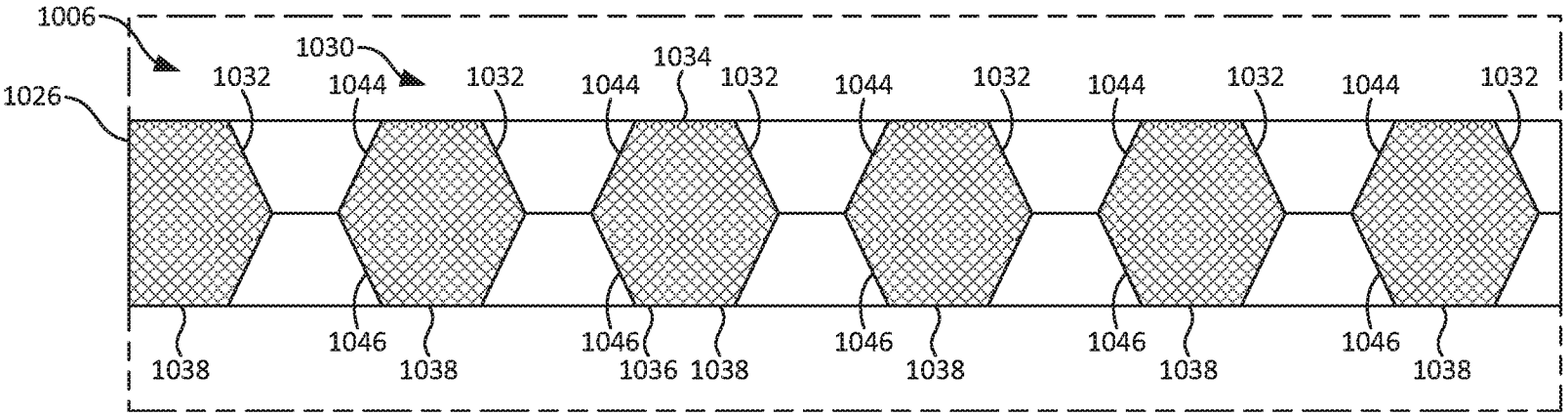
FIG. 10 illustrates a side section view of another embodiment of a force absorbing structure according to the present disclosure.
Figure 11:
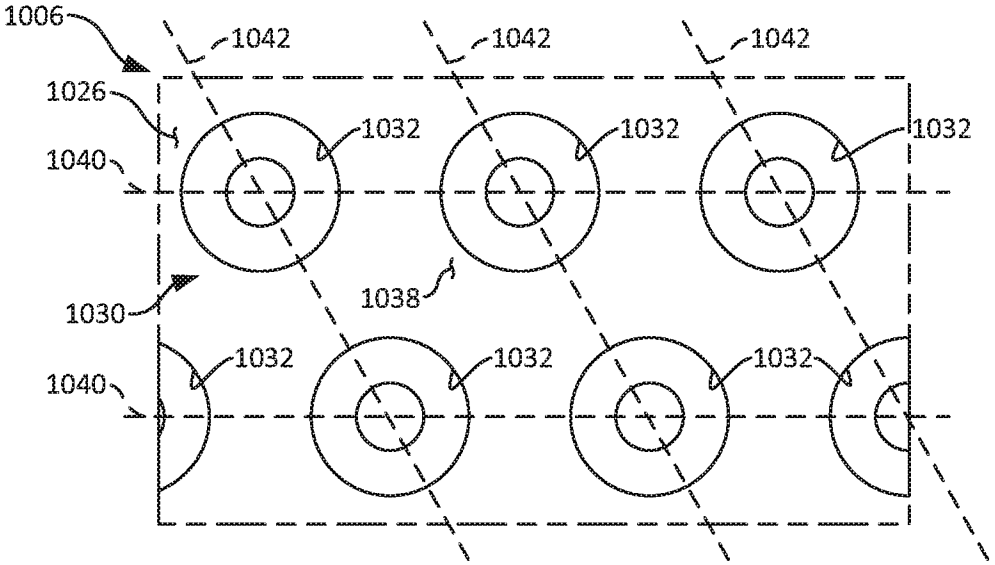
FIG. 11 illustrates a bottom view of the force absorbing structure of FIG. 10.

Referring now to FIGS. 10 and 11, an embodiment of a force absorbing structure 1006 is shown. The force absorbing structure 1006 may, for example, form a component of headgear 400 by replacing the force absorbing structure 406 described above. That is, in some embodiments headgear according to the present disclosure may include any of the components and features of headgear 400 described above, except that the force absorbing structure 1006 is used in place of the force absorbing structure 406.

The force absorbing structure 1006 is configured to absorb impact forces applied to the head of the wearer. The force absorbing structure 1006 may be formed, for example, from any of the materials described above in connection with the force absorbing structure 106. The force absorbing structure 1006 may have an overall shape, dimensions, and/or portions having different hardnesses like those described above in connection with the force absorbing structure 406.

Figure 12:
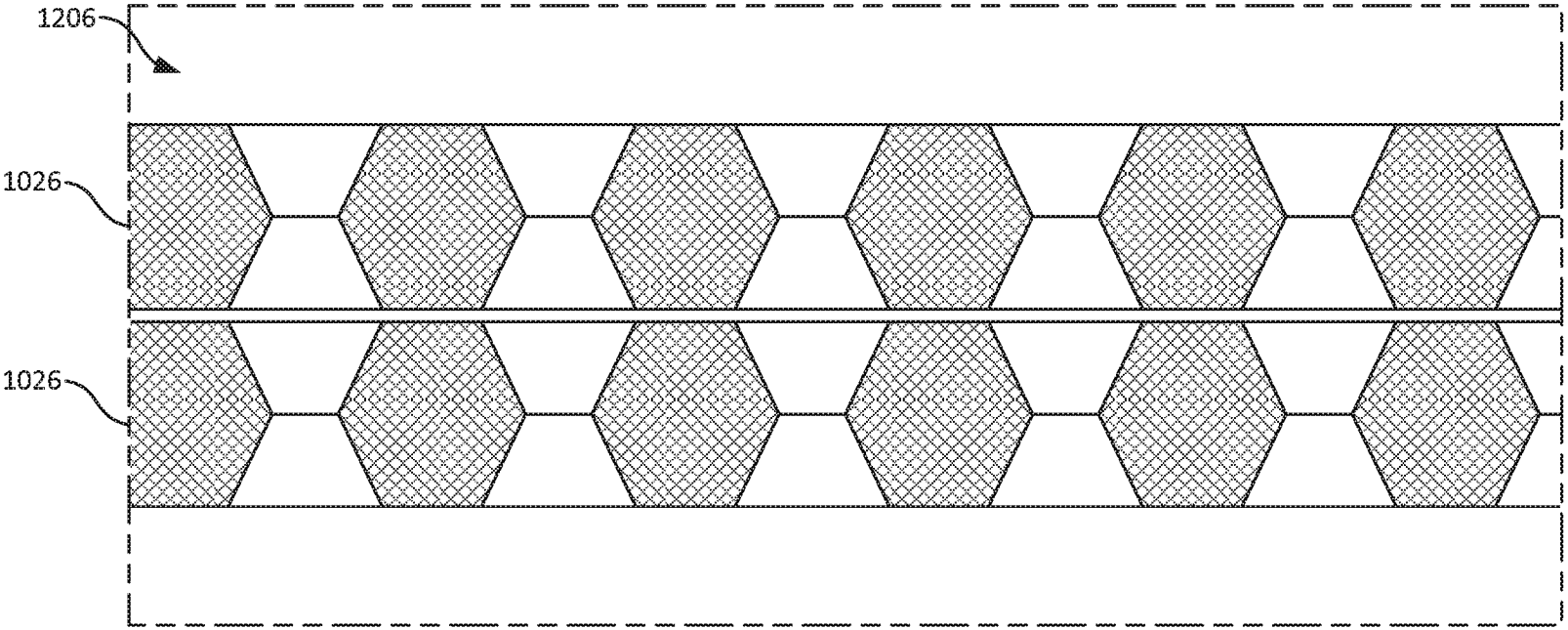
FIG. 12 illustrates a side section view of another embodiment of a force absorbing structure according to the present disclosure. Components are shown with gaps therebetween for illustrative purposes.

As illustrated in FIG. 10, the force absorbing structure 1006 may include a single layer 1026. In other embodiments, a force absorbing structure 1206 may include multiple layers 1026 (for example and as illustrated in FIG. 12, two layers 1026). Such layers may be detachably coupled, non-detachably coupled, or uncoupled. In some embodiments, such layers 1026 may differ from each other with regard to any of the properties described above (for example, hardness, damping coefficient, and the like).

The layer 1026 may have a porous macrostructure 1030. The porous macrostructure 1030 includes a plurality of passageways 1032, which may also be referred to as through holes, that extend from a first side 1034 of the layer 1026 to second side 1036 opposite the first side 1034. The material 1038 between adjacent passageways 1032 acts like a spring and facilitates absorbing impact forces applied to the force absorbing structure 1006. The passageways 1032 may have common dimensions (see FIGS. 10 and 11) or different dimensions (not shown). The passageways 1032 may be spaced apart by common distances (see FIGS. 10 and 11) or different distances (not shown). The passageways 1032 can have common shapes (see FIGS. 10 and 11) or different shapes (not shown). The passageways 1032 may be arranged in a pattern (see FIGS. 10 and 11). The passageways 1032 are aligned along first parallel directions 1040 on the layer 1026 and second parallel directions 1042 on the layer 1026, the first directions 1040 being non-orthogonal with the second directions 1042. The passageways 1032 may be arranged randomly (not shown).

In some embodiments, the passageways 1032 have a depth (that is, a direction extending in the top-bottom direction on FIG. 10), and the layer 1026 has a thickness, of at least about 2.00 mm (that is, 2.00 mm±0.25 mm), or at least about 4.00 mm (that is, 4.00 mm±0.25 mm), or at least about 6.00 mm (that is, 6.00 mm±0.25 mm). In some embodiments, one or more of the passageways 1032 are spaced apart from adjacent passageways 1032 by at least about 1.00 mm (that is, 1.00 mm±0.25 mm), or at least about 3.00 mm (that is, 3.00 mm±0.25 mm), or at least about 5.00 mm (that is, 5.00 mm±0.25 mm).

The passageways 1032 may have various shapes. As an example and as illustrated in the figures, the passageways 1032 may have open-ended hourglass shapes. Stated another way, the passageways 1032 may have narrowing double frusto-conical shapes. That is, each passageway 1032 is defined by a first frusto-conical shape 1044 and a second frusto-conical shape 1046. The larger end of the first frusto-conical shape 1044 is disposed at the first side 1034 of the layer 1026, the larger end of the second frusto-conical shape 1046 is disposed at the second side 1036 of the layer 1026, and the frusto-conical shapes 1044 and 1046 have a common smaller end within the layer 1026.

In some embodiments, the frusto-conical shapes 1044 and 1046 each have a depth that is about half of the thickness of the layer 1026 (that is, 50 percent of the thickness of the layer 1026 ±5 percent).

In some embodiments, the passageways 1032 have a maximum width (that is, a dimension perpendicular to the thickness of the layer 1026, and being the greatest width relative to all other widths of the passageways 1032) of at least about 2.00 mm (that is, 2.00 mm±0.25mm), or at least about 3.50 mm (that is, 3.50 mm±0.25 mm), or at least about 5.00 mm (that is, 5.00 mm±0.25 mm). As an example, the maximum width of the frusto-conical shapes 1044 and 1046 is their maximum diameter (that is, the diameter at their larger ends), and the maximum diameter is at least about 2.00 mm (that is, 2.00 mm±0.25 mm), or at least about 3.50 mm (that is, 3.50 mm±0.25 mm), or at least about 5.00 mm (that is, 5.00 mm±0.25 mm).

In some embodiments, the passageways 1032 have a minimum width (that is, the smallest width relative to all other widths of the passageways 1032) of at least about 0.50 mm (that is, 0.50 mm±0.25 mm), or at least about 1.25 mm (that is, 1.25 mm±0.25 mm), or at least about 2.00 mm (that is, 2.00 mm±0.25 mm). As an example, the minimum width of the frusto-conical shapes 1044 and 1046 is their minimum diameter (that is, the diameter at their common smaller end), and the minimum diameter is at least about 0.50 mm (that is, 0.50 mm±0.25 mm), or at least about 1.25 mm (that is, 1.25 mm±0.25 mm), or at least about 2.00 mm (that is, 2.00 mm±0.25 mm).

In other embodiments (not shown), the passageways 1032 have other open-ended shapes. For example, the passageways 1032 may have other tapering shapes (for example, frusto-elliptic paraboloidal, hyperbolic hyperboloidal, double frusto-spherical, frusto-pyramidal, narrowing double frusto-pyramidal, and the like), non-tapering shapes (for example, circular cylindical, elliptical cylindrical, polyhedral, and the like), other axisymmetric shapes (for example, frusto-conical, circular cylindrical, double frusto-spherical, and the like), non-axisymmetric shapes (for example, frusto-pyramidal, polyhedral, and the like), other shapes that are symmetric over a plane bisecting the layer 1026 (for example, hyperbolic hyperboloidal, double frusto-spherical, narrowing double frusto-pyramidal, and the like), or shapes that are asymmetric over the plane bisecting the layer 1026 (for example, frusto-elliptic paraboloidal, frusto-pyramidal, and the like). Passageways 1032 having other open-ended shapes may have maximum widths and minimum widths as described above.

In some embodiments, headgear according to the present disclosure does not include a substantially rigid shell or, stated another way, is not a helmet, such as a football helmet, a hockey helmet, a lacrosse helmet, a rock climbing helmet, a bicycle helmet, a motorcycle helmet, a snowmobile helmet, or a skiing helmet. In some embodiments, headgear according to the present disclosure is not detachably coupled to the interior of the substantially rigid shell of a helmet. In some embodiments, headgear according to the present disclosure is detachably coupled to the interior of the substantially rigid shell of a helmet. In some embodiments, headgear does not include a faceguard. In some embodiments, headgear does not include a chin strap. In some embodiments, headgear does not include a portion that protects the top of the head of the wearer.

The various dimensions presented herein (for example, length and height) are exemplary. As those skilled in the art will appreciate, any of the dimensions can vary to accommodate the size of the head of different types of wearers (for example, headgear may be provided with sizes of adult large, adult medium, adult small, child large, child medium, child small, and the like).

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

What is claimed is:

1. Headgear configured to be worn on the head of a wearer, comprising:

a base configured to engage the head of the wearer; and a force absorbing structure carried by the base, the force absorbing structure comprising a surface comprising a coarse macrostructure configured to facilitate absorbing forces applied to the headgear, the coarse macrostructure comprising a plurality of protrusions, and at least one of the protrusions comprising a thickness of at least about 0.50 mm; wherein the force absorbing structure comprises:

a first layer comprising the coarse macrostructure, the coarse macrostructure being a first coarse macrostructure; and a second layer comprising a surface comprising a second coarse macrostructure configured to facilitate absorbing forces applied to the headgear, the second coarse macrostructure comprising a plurality of protrusions, and at least one of the protrusions comprising a thickness of at least about 0.50 mm.

2. The headgear of claim 1, wherein at least some of the protrusions are defined by a plurality of recesses, and at least some of the recesses comprise concave semi-spherical surfaces.

3. The headgear of claim 1, wherein at least some of the protrusions of the first coarse macrostructure are defined by a first plurality of recesses, at least some of the first plurality of recesses comprise concave semi-spherical surfaces, wherein at least some of the protrusions of the second coarse macrostructure are defined by a second plurality of recesses, at least some of the second plurality of recesses comprise concave semi-spherical surfaces.

4. The headgear of claim 3, wherein at least some of the first plurality of recesses face toward the second layer, and at least some of the second plurality of recesses face toward the first layer.

5. The headgear of claim 1, wherein at least some of the protrusions are arranged in a pattern.

6. The headgear of claim 1, wherein the force absorbing structure comprises a viscoelastic polymer.

7. The headgear of claim 1, wherein the force absorbing structure comprises a material having a damping coefficient in a range of 0.54 to 0.35.

8. Headgear configured to be worn on the head of a wearer, comprising:

a base configured to engage the head of the wearer; and a force absorbing structure carried by the base, the force absorbing structure comprising a surface comprising a coarse macrostructure configured to facilitate absorbing forces applied to the headgear, the coarse macrostructure comprising a plurality of protrusions, and at least one of the protrusions comprising a thickness of at least about 0.50 mm, wherein the force absorbing structure comprises:

a first portion having a first damping coefficient; and a second portion having a second damping coefficient;

wherein the first damping coefficient is greater than the second damping coefficient.

9. The headgear of claim 8, wherein the base defines an internal chamber, and the force absorbing structure is carried within the internal chamber.

10. Headgear configured to be worn on the head of a wearer, comprising:

a base configured to engage the head of the wearer; and a force absorbing structure carried by the base, the force absorbing structure comprising a viscoelastic polymer to facilitate absorbing forces applied to the headgear, wherein the force absorbing structure comprises:

a first portion having a first damping coefficient; and a second portion having a second damping coefficient;

wherein the first damping coefficient is greater than the second damping coefficient.

11. Headgear configured to be worn on the head of a wearer, comprising:

a base configured to engage the head of the wearer; and a force absorbing structure carried by the base, the force absorbing structure comprising a porous macrostructure configured to facilitate absorbing forces applied to the headgear, the porous macrostructure comprising a plurality of passageways extending in a thickness direction from a first side of the force absorbing structure to a second side of the force absorbing structure, the plurality of passageways each comprising a width in a direction perpendicular to the thickness direction, and the width being at least about 2.00 mm; wherein the plurality of passageways each comprise a tapering shape, and the width is a maximum width.

12. The headgear of claim 11, wherein the plurality of passageways each comprise a symmetric tapering shape.

13. The headgear of claim 10, wherein the viscoelastic polymer is a thermoset, polyether-based polyurethane.

14. The headgear of claim 10, wherein the force absorbing structure comprises a material having a damping coefficient in a range of 0.54 to 0.35.

15. The headgear of claim 10, wherein the base defines an internal chamber, and the force absorbing structure is carried within the internal chamber.

16. The headgear of claim 10, wherein the base comprises a fabric.

* * * * *